United States Patent [19]

Sanders et al.

[11] Patent Number: 4,530,122

[45] Date of Patent: Jul. 23, 1985

[54] PATIENT WEIGHT RELIEVER APPARATUS

[75] Inventors: Robert C. Sanders; Donald M. Sanders, both of Sacramento, Calif.

[73] Assignee: Sanders EZ Mobility Systems, Sacramento, Calif.

[21] Appl. No.: 385,971

[22] Filed: Jun. 7, 1982

[51] Int. Cl.[3] ..... A61G 7/10

[52] U.S. Cl. ..... 5/83; 5/81 R; 5/85

[58] Field of Search ..... 5/81 R, 83, 84–89; 297/465, DIG. 4, DIG. 10; 128/80 G, 87 R; 254/385, 386

[56] References Cited

U.S. PATENT DOCUMENTS

| | | | |
|---|---|---|---|
| 292,048 | 1/1884 | Reed | 5/87 |
| 785,855 | 3/1905 | Camp | 5/89 |
| 1,085,704 | 2/1914 | Roush et al. | 5/86 |
| 1,856,785 | 5/1932 | Phillips | 5/83 |
| 2,688,410 | 9/1954 | Nelson | 5/86 |
| 2,891,256 | 6/1959 | Scully | 5/86 |
| 2,962,730 | 12/1960 | Carnes et al. . | |
| 3,137,011 | 6/1964 | Fischer . | |
| 3,205,512 | 9/1965 | Camper | 5/86 |
| 3,597,774 | 8/1971 | Warren | 5/84 |
| 3,638,647 | 12/1972 | Creelman | 297/468 |
| 3,787,089 | 1/1974 | Wrethander . | |
| 3,894,303 | 7/1975 | Angel | 5/81 R |
| 3,992,040 | 11/1976 | Gannac | 297/465 |
| 4,070,721 | 1/1978 | Stasko . | |
| 4,141,094 | 2/1979 | Ferguson et al. . | |
| 4,143,654 | 3/1979 | Sherman | 128/87 R |
| 4,193,147 | 3/1980 | Fischer . | |
| 4,221,011 | 9/1980 | Flinchbaugh . | |

FOREIGN PATENT DOCUMENTS

| | | | |
|---|---|---|---|
| 1046202 | 1/1979 | Canada | 5/89 |
| 12198 | 5/1918 | United Kingdom | 5/87 |

*Primary Examiner*—Gary L. Smith
*Assistant Examiner*—Michael F. Trettel
*Attorney, Agent, or Firm*—Townsend & Townsend

[57] ABSTRACT

Apparatus for at least partially lifting a patient from a bed or a wheelchair includes a support frame having upright supports and an overhead member, a patient sling designed to support the patient at places other than the patient's normal bed sore contact points, and a mechanism attached to the overhead support for vertically lifting the sling and patient. The support frame can be mounted to the wheelchair or bed frame or it can be free standing. The lifting mechanism can either be power driven or manually operated. The manual lifting mechanism may include an eccentrically mounted roller about which is wrapped a lifting line. A bed patient sling includes a pair of relatively stiff sides preferably shaped to conform to the lateral sides of the patient. A number of body support straps attached to the sides support the patient's body at points other than at the contact points between the patient's body and the bed. The sides are separated by adjustable, removable separator bars to keep the sling from squeezing the patient being lifted.

13 Claims, 7 Drawing Figures

PATIENT WEIGHT RELIEVER APPARATUS

BACKGROUND OF THE INVENTION

Persons confined to a wheelchair or a bed often suffer from pressure-induced ulcerations of the skin, commonly called bedsores, at high points on their bodies which support a large proportion of their weight. These bedsore contact points are typically on the upper portion of the back, the shoulders, the buttocks and often the thighs and calves. Bedsores can be very serious because the subsurface muscles, as well as the surface sores, may become infected.

One method for reducing bedsores of bedridden patients is through the use of articulated beds. Changing the shape of the bed support surface shifts the patient's weight on the patient's back and side. However these beds typically do not eliminate the pressure on the contact points but only change the amount of the weight on the contact points.

U.S. Pat. No. 4,141,094, suggests the use of a harness to lift a wheelchair bound patient a small distance to relieve the pressure on the spine and buttocks. However, the harness disclosed relies upon support straps placed between the juncture of the upper thighs and the buttocks so that pressure on possible bedsore contact points is not eliminated.

Other apparatus for lifting and carrying bedridden and wheelchair bound patients generally use some type of a sling for supporting the patient during lifting and transportation. However, these slings also generally support the patient at bedsore contact points so that such devices would not be useful in relieving the body pressure on the contact points at which bedsores can occur. Such slings are shown in U.S. Pat. Nos. 2,962,730; 3,137,011 and 4,070,721.

What is needed, but not found in the prior art, is apparatus for lifting a patient a short distance from a bed or a wheelchair which includes a sling supporting the patient at points other than the normal contact points between the patient's body and the bed or wheelchair.

SUMMARY OF THE INVENTION

Apparatus is disclosed for at least partially lifting a patient from a bed or a wheelchair. The apparatus includes a support frame having an overhead member, a patient sling which supports the patient at places other than the normal contact points on the patient's body, and a mechanism attached to the overhead support for vertically lifting the sling and patient.

The support frame can be of two different types. The first is a free standing support frame including a base, spaced apart upright side supports, and an overhead member extending between the upper ends of the side supports. When used with a wheelchair the patient is positioned between the side supports and under the overhead member. The free standing frame is also used for bedridden patients. The second type of support frame includes a pair of upright supports and an overhead member. The side supports are mounted either to the frame of a wheelchair or the sides of a bed.

The lifting mechanism can either be power driven or manually operated. The power driven type typically includes a winch type motor regulated by a controller within reach of the patient. The manual lifting mechanism may include an eccentric roller pivotally mounted to the overhead support and about which is wrapped a line whose lower end is attached to the patient sling. A relatively long handle is rigidly attached to the roller. Pulling the handle downwardly towards the patient winds the line onto the surface of the roller to raise the patient.

Two types of slings are disclosed. The first is used to lift a wheelchair patient and includes a relatively stiff torso strap sized to fit around the patient's ribcage. A ring is attached to the backside of the torso strap. A hook at the lower end of the line is fastened to the ring. Although the torso strap passes over areas which may include normal contact points on the patient's back, the lifting force is primarily on the patient's chest because the lifting point is opposite the center of their back. Therefore when the patient is lifted a short distance from a wheelchair by the wheelchair sling, pressure on contact points is relieved to aid in the prevention of bed sores.

A bed patient sling, used for lifting bedridden patients, includes a pair of relatively stiff sides which are preferably shaped to generally conform to the lateral contour of the patient. A number of body support straps are attached to the sides for supporting the patient's body at points other than at the contact points between the patient's body and the bed. Typically support is provided at three places: under the neck, under the lumbar region of the back, and under the ankles. The neck and back straps are attached to and extend between the two sides. A pair of straps, one mounted to each side, are used to support a patient's body at the ankles in preference to a single strap extending between the two sides. The lateral separation between the sides is maintained by a pair of adjustable length rigid separator bars which are removeably mounted between the sides. The ends of the separator bars include eyes for engagement with lifting hooks at the ends of the bed sling lifting lines.

The primary feature of the present invention is the use of patient slings which support the patient at points on the patient's body which are not the normal contact points between the body and the bed or wheelchair. Pressure on the contact points can therefore be relieved by the apparatus to help prevent the formation of bed sores. The disclosed slings can be used for patients who are physically unable to support themselves and can also be used to lift unconsious patients. Another key feature of the invention is the provision of a bed patient sling including separator bars which insure that the sides of the sling do not squeeze the patient while being lifted.

The free-standing support allows the invention to be used with any wheelchair or bed with no modification to either. The same apparatus can be used for several wheelchair patients by merely wheeling the patient to a point beneath the overhead support and then lifting the patient a few inches off the wheelchair seat. After a length of time the patient can be reseated, uncoupled from the line and another patient can use the apparatus. A single apparatus, including the free-standing frame, can likewise be used for several bedridden patients by serially assembling the apparatus at the beds. Cost is therefore kept low.

The apparatus is easily adapted for use with either mechanical or electrical lifting mechanisms. The manual lifting mechanism preferably includes an eccentric roller so that the lifting line is wound about the roller in a manner which is not directly proportional to the arc of travel of the roller. This permits the slack in the lifting line to be quickly taken up during the initial rotation of the roller and allows the lifting line to be taken up more slowly as the weight of the patient on the lifting line increases. This variable mechanical advantage allows even physically feeble patients to lift themselves from their wheelchair or bed.

Other features and advantages of the present invention will be apparent from the following description in which the preferred embodiments have been set forth in conjunction with the accompanying drawings.

DETAILED DESCRIPTION OF THE PREFERRED EMBODIMENTS

Figure 1:
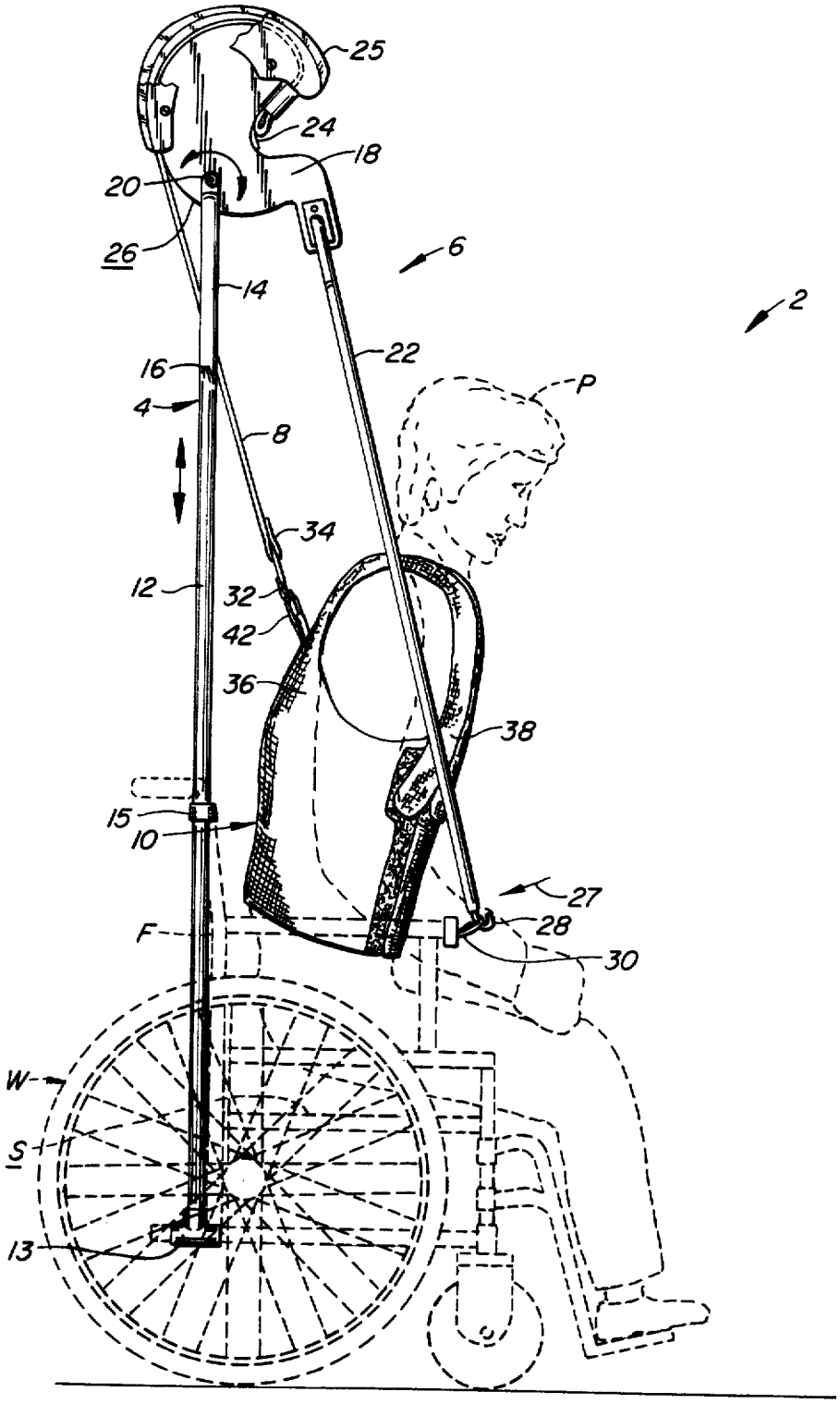
FIG. 1 is a side view the patient weight reliever apparatus of the present invention incorporating a manual lifting mechanism and a wheelchair mounted support frame.
Figure 2:
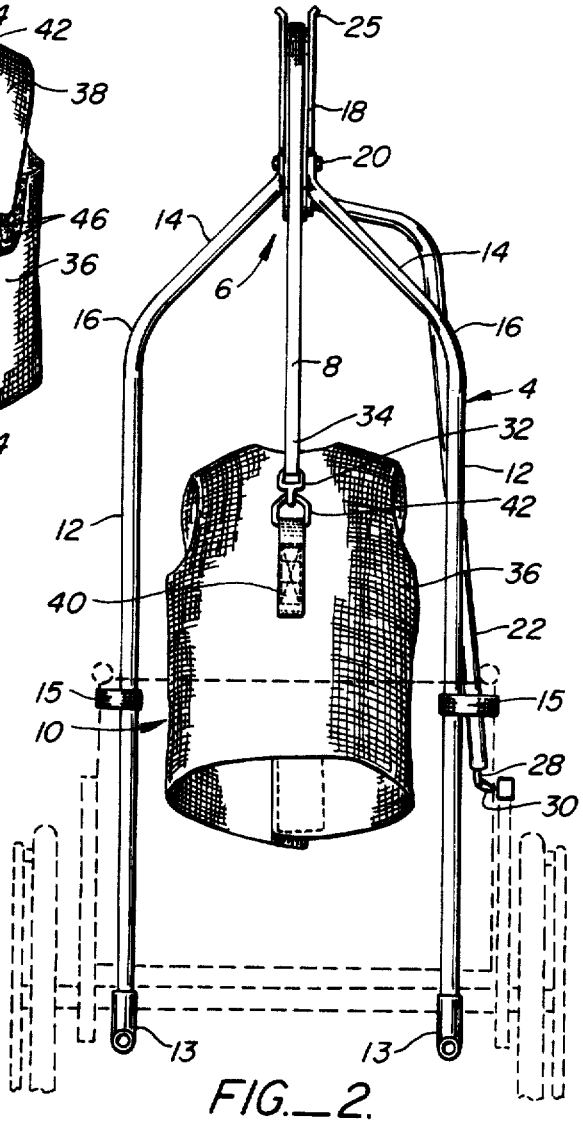
FIG. 2 is a rear view of the apparatus of FIG. 1.

The patient weight reliever apparatus 2 of the present invention is shown in its various configurations in the figures. Referring now to FIGS. 1 and 2, broadly the invention includes a support frame 4 to which is mounted a lifting mechanism 6 having a lifting line 8 for attachment to a patient sling 10. In the figures two different support frames, lifting mechanisms and patient slings are disclosed. The invention will be first described with reference to the apparatus disclosed in FIGS. 1 and 2 and the other embodiments will be discussed later.

Support frame 4 is a wheelchair mounted support frame and has a pair of upright supports 12 mounted in a conventional fashion by T-couplings 13 and clamps 15 to the frame F of a wheelchair W, shown in phantom lines. Frame 4 also includes an overhead member 14 supported at the upper end 16 of upright supports 12. Lifting mechanism 6 includes an eccentric roller 18 pivotally mounted at the center of member 14 at a pivot point 20. An elongate handle 22 rigidly attached to roller 18 is used to rotate roller 18 about pivot point 20. An upper end 24 of lifting line 8 is fixed to roller 18. Line 8 is passed over an outer camming surface 26 of roller 18 between guide plates 25. Movement of handle 22 in the direction of arrow 27 rotates eccentric cam roller 18 to raise line 8 thus raising patient sling 10 and patient P therewith. Handle 22 has a hook 28 at its lower end for engagement with a loop 30 of material fastened to an arm rest of the wheelchair to keep line 8, and thus patient sling 10, raised.

Figure 3:
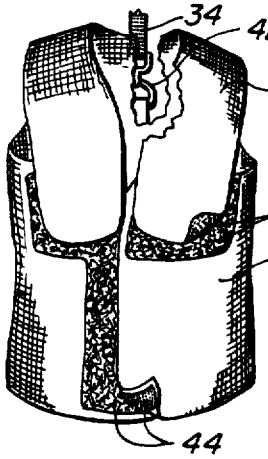
FIG. 3 is a front view of the wheelchair patient sling.

Line 8 is removeably attached to sling 10 by a hook 32 at the lower end 34 of line 8. Patient sling 10, shown in FIGS. 1–3, is a wheelchair patient sling and includes a relatively wide, relatively stiff torso strap 36 and a pair of shoulder flaps 38. A vertically extending strap 40 is mounted along the backside of strap 36. A ring 42 is connected to the upper end of strap 40 and provides an attachment point for hook 32. Strap 36 and flaps 38 include releasable attachment strips 44, 46 (such as sold under the trademark Velcro) for their placement about the patient and adjustment to the appropriate size.

In use support frame 4 is mounted to frame F by T-coupling 13 and clamps 15. When the patient wishes to relieve the weight from his or her contact points, hook 32 is attached to ring 42 and handle 22 is pulled towards the patient until the proper height is achieved. As can be seen in FIG. 1 patient P is lifted a short distance above the seating surface S of wheelchair W. By using an eccentric cam roller, the effective lever arm between pivot point 20 and the point at which lifting line 8 first engages surface 26 varies depending upon the angular position of handle 22. In the disclosed embodiment the lever arm decreases as handle 22 is pulled towards the patient thus compensating for the variation in the weight on line 8 between the beginning of the raising of patient sling 10, at which very little weight of the patient is actually supported, and the fully raised patient position, at which most of the patient's weight is supported by line 8. Thus the maximum force which must be applied to handle 22 can be minimized without increasing the arc over which it must travel.

Figure 4:
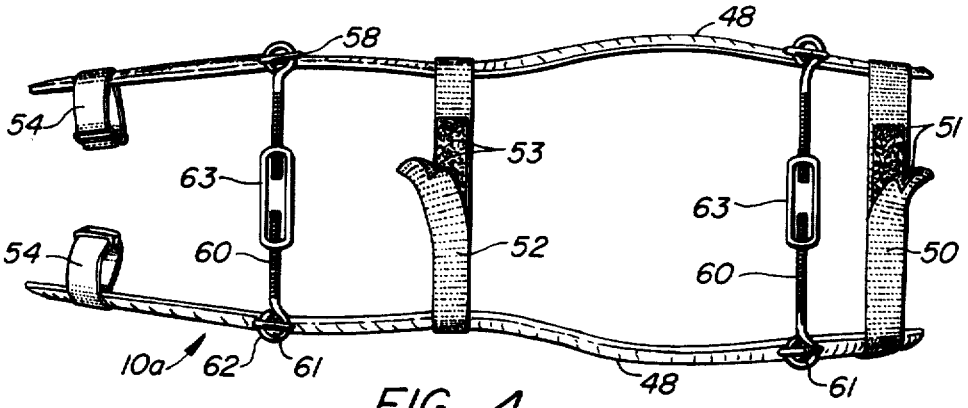
FIG. 4 is a top view of a bed patient sling.
Figure 5:
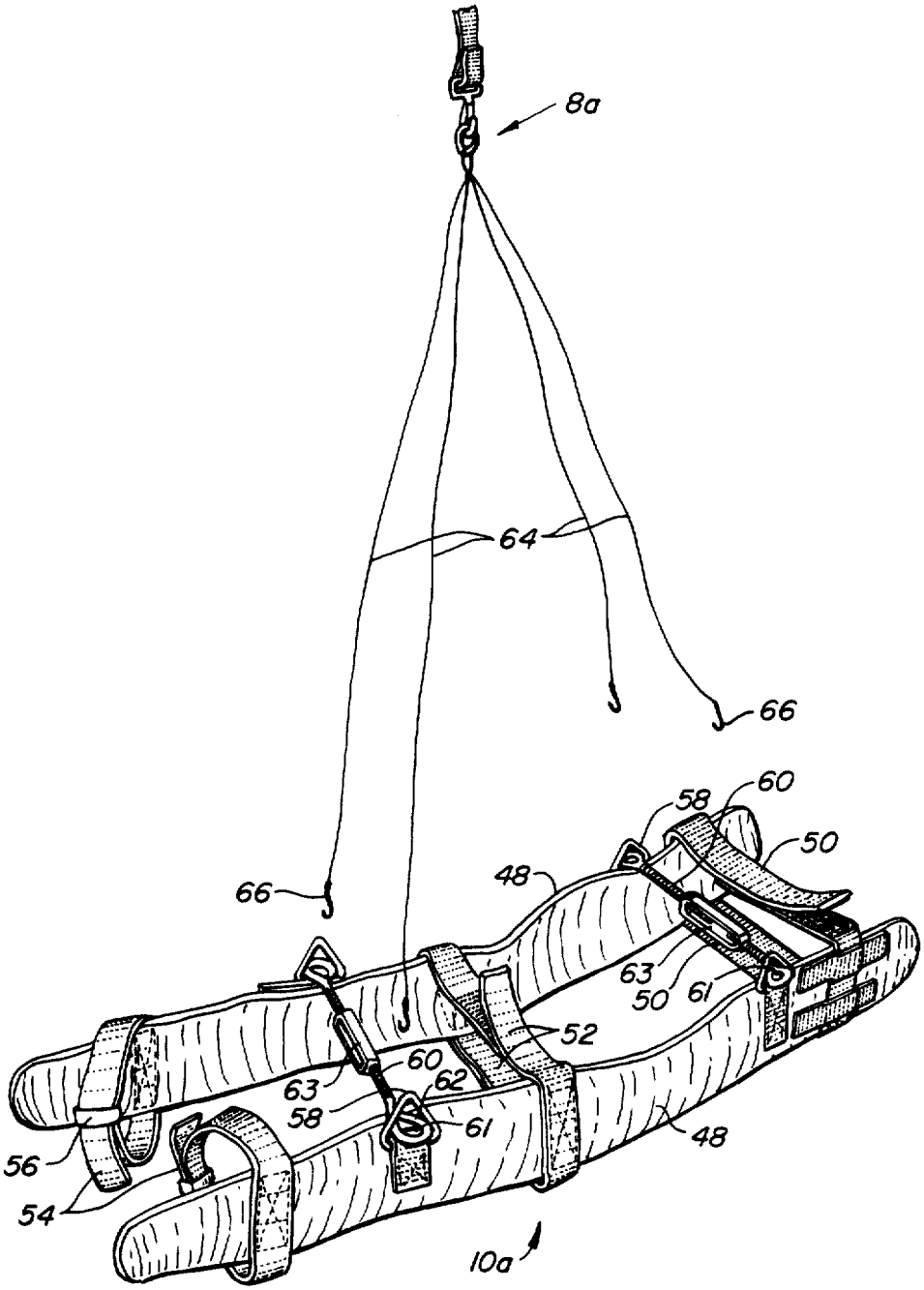
FIG. 5 is a perspective view of the bed patient sling of FIG. 4 and showing a bed sling lifting line.

Referring now to FIGS. 4 and 5, a bed patient sling **10*a* is disclosed. Sling 10*a* includes a pair of relatively stiff, outwardly curving vertical sides 48 shaped to generally conform to the lateral contour of the patient. Sling 10*a* includes several body support straps to support the patient at points on the patient's body other than the patient's contact points with the bed. The support straps include a neck strap 50 mounted between the two sides at one end of sling 10*a*, a back strap 52 also mounted between sides 48 and positioned to support the patient at the lumbar region of the patient's back, and a pair of ankle straps 54, one mounted to each side 48 at the end of sling 10*a* opposite neck strap 50. The ankle straps are positioned to support the patient's legs in the area of the patient's ankle. Straps 54 are each adjustable using a conventional keeper or buckle 56. The ends of neck strip 50 and back strap 52 are fastened together using Velcro retaining strips 51, 53**.

A number of triangular metal loops 58 are attached to sides 48. A separator bar 60, having an enlarged eye 62 at each end, is placed between each pair of opposed loops 58 so that eye 62 partially passes through loop 58. The combination of separator bars 60 and loops 58 provide lifting points 61 for raising patient sling **10*a* and also keeps the two sides from moving together to prevent squeezing the patient while being lifted. Bars 60 include turnbuckles 63 so that the length of the bars, and the separation of sides 48**, can be adjusted.

A lifting line **8*a* is used with bed patient sling 10*a* and includes several bed sling line segments 64 each having a lifting hook 66 at its lower end. Hooks 66 are passed through lifting points 61 which are defined by the portion of eyes 62 which extend through triangular loop 58. When bed patient sling 10*a* is lifted, the weight of the patient on back strap 52 and neck strap 50 tends to draw sides 48 together. However eyes 62 and loops 58 are configured so that eyes 62 do not pass through triangular loop 58 due to the weight of the patient to ensure sides 48** remain separated.

The bed patient sling **10*a* disclosed in FIGS. 4 and 5 can be used with the support frame and lifting mechanism disclosed in FIGS. 1–3. Of course upright supports 12** would be mounted to the sides of the bedframe for the bedridden patient.

Figure 6:
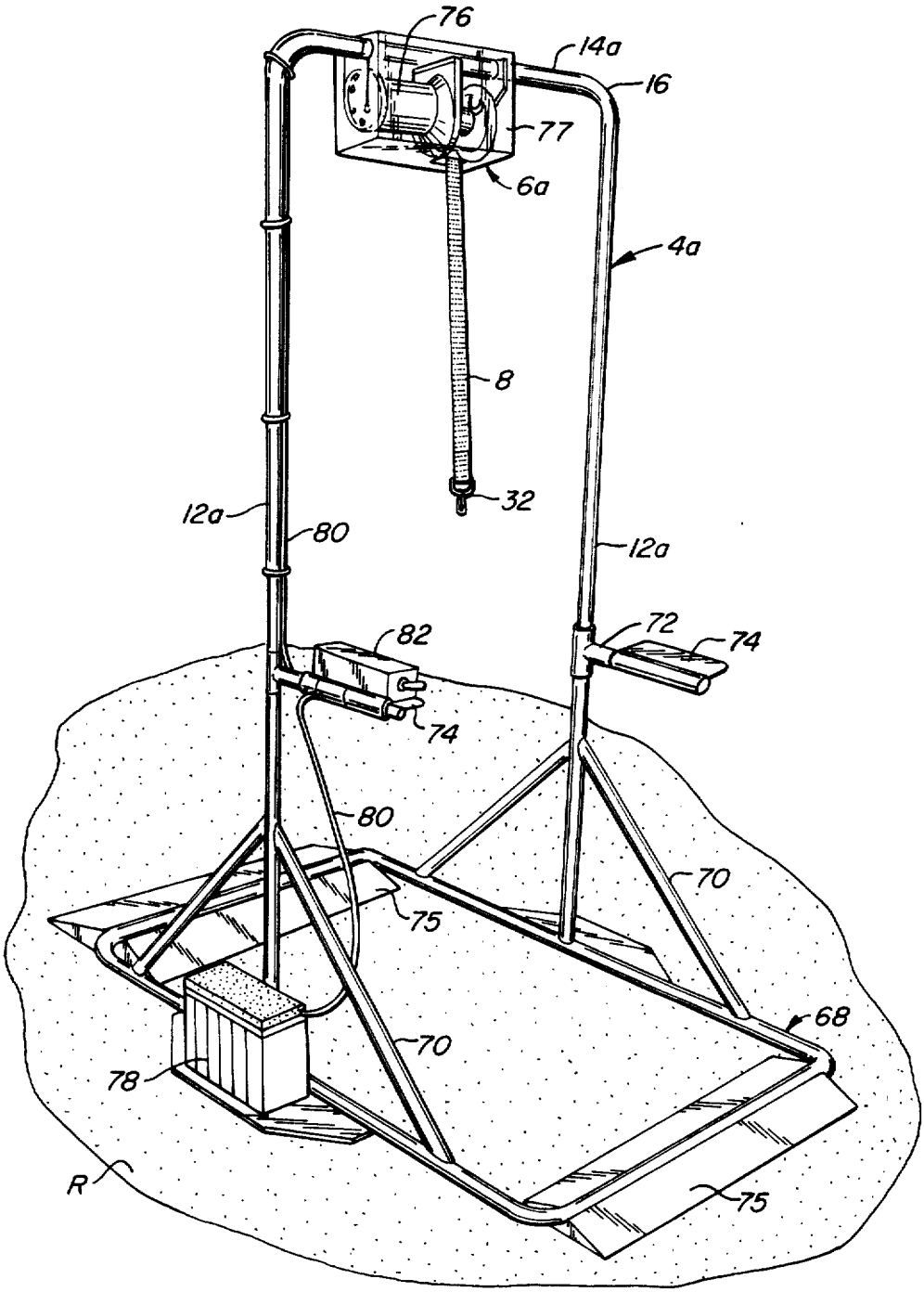
FIG. 6 is a perspective view of the apparatus of the invention incorporating the free-standing support frame and a motor driven lifting mechanism.

Referring now to FIG. 6, alternative embodiments of the support frame and lifting mechanism are disclosed.

Free-standing support frame 4a includes a pair of upright supports 12a mounted to a base 68 which rests on floor R. An overhead support 14a is mounted at the upper ends 16 of supports 12a. Base 68 is a generally rectangular, relatively flat tubular structure. Brace members 70 help support side supports 12a on base 68. A pair of arms 72 extend from side supports 12a; each arm includes generally flat mounting platform 74 at its outer end. Frame 4a is sized so that a wheelchair may be positioned between upright supports 12a. Ramps 75 can be used to aid positioning the wheelchair between supports 12a. If used with a bed, frame 4a is sized so base 68 can be placed under the bed with supports 12a positioned adjacent the sides of the bed. See FIG. 7.

Lifting mechanism 6a includes a winch type electric motor 76 mounted centrally to overhead support 14a and enclosed within a clear plastic box 77. Motor 76 is used to raise and lower hook 32 at the end of lifting line 8. Motor 76 is powered by a battery 78 through conductor 80. Battery 78 may be enclosed within a protective enclosure if desired. A conventional controller 82 is used along conductor 80 to control the operation of motor 76. Controller 82 is mounted on an arm 72 so that it may be operated by the patient. If support frame 4a is used with manual lifting mechanism 6, a loop 30 of material may be mounted to arm 72 for engagement with hook 28.

Figure 7:
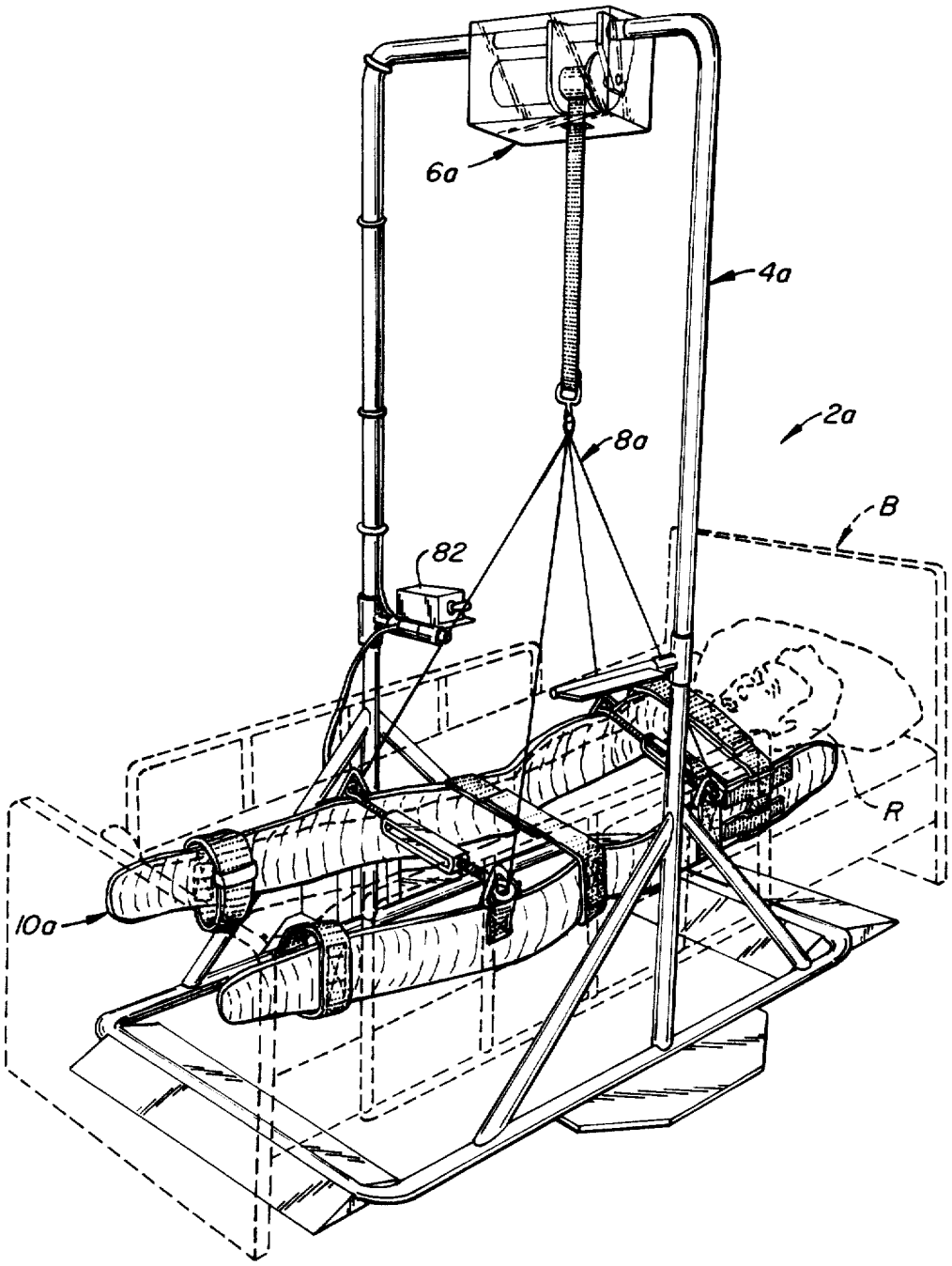
FIG. 7 is a perspective view of the apparatus of FIGS. 5 and 6 supporting a patient in a bed.

Lifting mechanisms 6 and 6a can be used with either patient sling 10 or bed patient sling 10a. Also, support frames 4 and 4a can be used for either wheelchair bound or bedridden patients. The use of support frame 4a shown in FIG. 5 is economical because a number of patients can use the same apparatus for weight release. A wheelchair patient is wheeled under overhead support 14a connected to hook 32 and raised the appropriate distance. After a period of time a patient can be lowered, released from hook 32 and moved away from the apparatus so that another patient can use the support frame and lifting mechanism. Also, the free-standing support frame of FIG. 6 can be used with bed patients as shown in FIG. 7. In any case, no modification to either the bed or the wheelchair is required when using the free-standing support frame 4a.

FIG. 7 shows the combination of the support frame 4a and lifting mechanism 6a of FIG. 6 with the bed patient sling 10a and lifting line 8a of FIG. 5. The resulting weight reliever apparatus 2a is shown used with a bed-ridden patient R lying in a bed B. Lifting mechanism 6a can be actuated through controller 82 by either the patient or another person to lift sling 10a the desired amount.

Modification and variation can be made to the disclosed embodiments without departing from the subject of the invention as defined in the following claims. For example, the support frame may be mounted directly to floor R for use with wheelchair or bedridden patients if desired.

We claim:

1. Patient weight reliever apparatus for at least partially lifting a patient from a support structure, such as a bed or a wheelchair, comprising:

a support frame including first and second spaced apart upright supports, an overhead support member connecting the upper ends of said upright supports and means for supporting said upright supports in a generally vertical attitude;

vertical lift means mounted to said overhead support member including an eccentric roller pivotally mounted to said overhead support member at a pivot point and a lift line connected to the roller at one end, said roller adapted to wind a portion of said lift line onto and off of a cam surface thereof when said eccentric roller pivots about said pivot point;

a patient sling adapted to support the patient when lifted by said lift means;

means for selectively coupling said lift line and said sling; and handle means for actuating said lift means to raise said sling and patient a desired distance to relieve pressure on the patient's contact points.

2. Patient weight reliever apparatus for at least partially lifting a patient from a support structure, such as a bed or wheelchair, comprising:

a support frame including first and second spaced apart upright supports, an overhead support member connecting the upper ends of said upright supports and means for supporting said upright supports in a generally vertical attitude;

vertical lift means mounted to said overhead support member including an eccentric roller pivotally mounted to said overhead support member at a pivot point and a lift line connected to the roller at one end and to said sling at another end, said roller adapted to wind a portion of said lift line onto and off of a cam surface thereof when said eccentric roller pivots about said pivot point;

a patient sling adapted to at least partially surround the patient and to support the patient when lifted by said lift means at points other than normal bedsore contact points between the patient and the support structure;

means for selectively coupling said lift means and said sling; and means for actuating said lift means to raise said sling and patient a desired distance to relieve pressure on the patient's contact points.

3. The apparatus of claim 2 wherein said actuating means includes handle means for rotating said roller about said pivot point to raise and lower said sling and the patient therewith.

4. Patient weight reliever apparatus for at least partially lifting a patient from a support structure, such as a bed, comprising:

a support frame including first and second spaced apart upright supports, an overhead support member connecting the upper ends of said upright supports and means for supporting said upright supports in a generally vertical attitude;

vertical lift means mounted to said overhead support member;

a patient sling adapted to at least partially surround the patient and to support the patient when lifted by said lift means at points other then normal bedsore contact points between the patient and the support structure, said sling being adapted for use wth a bedridden patient and including a pair of relatively stiff elongate sides, rigid side separators mounted between the sides to keep the sides spaced apart one from the other when said sling is lifted by said lift means, and patient support straps attached to said sides to support the patient's body;

means for selectively coupling said lift means and said sling; and means for actuating said lift means to raise said sling and patient a desired distance to relieve pressure on the patient's contact points.

5. The apparatus of claim 4 wherein said sides are shaped to generally conform to the lateral contour of the patient's body.

6. The apparatus of claim 4 wherein said side separators are adjustable in length and are removably mounted between said sides.

7. The apparatus of claim 4 wherein said patient support straps include a neck strap suspended between said sides and adapted to support the patient in the area of the patient's neck, a lower back strap suspended between said sides and adapted to support the patient in the lumbar region of the patient's back, and ankle strap support means connected to the sides and adapted to support the patient in the area of the patient's ankles.

8. The apparatus of claim 7 wherein said ankle strap support means includes two ankle straps, one connected to either side.

9. A patient sling for lifting a generally horizontal patient, said patient having bedsore contact points, comprising:

a pair of relatively stiff elongate sides, said sides having means for providing lift points for raising said sides;

rigid side separators mounted between said sides to keep said sides spaced apart one from the other when said sling is lifted at said lift points; and patient support straps attached to said sides to support the patient's body, said straps adapted for supporting the patient at points other than the bedsore contact points so that when the patient is lifted by the sling, pressure on the contact points is relieved.

10. The apparatus of claim 9 wherein said sides are shaped to generally conform to the lateral contour of the patient's body.

11. The apparatus of claim 9 wherein said side separators are removably mounted to said sides.

12. The apparatus of claim 9 wherein said patient support straps include a neck strap suspended between said sides and adapted to support the patient in the area of the patient's neck, a lower back strap suspended between said sides and adapted to support the patient in the lumber region of the patient's back, and ankle strap support means connected to the sides and adapted to support the patient in the area of the patient's ankles.

13. The apparatus of claim 12 wherein said ankle strap support means includes two ankle straps, one connected to either side.

* * * * *